US006008439A

United States Patent [19]

Kovac et al.

[11] Patent Number: 6,008,439

[45] Date of Patent: Dec. 28, 1999

[54] PEDAL SHARPING APPARATUS FOR FOLK HARPS

[76] Inventors: John G. Kovac, 148 High Spruce Rd., Front Royal, Va. 22630; Nicholas Economos, 5504 Deer Run Dr., Fort Pierce, Fla. 34951

[21] Appl. No.: 08/888,133

[22] Filed: Jul. 3, 1997

[51] Int. Cl.[6] ..... G10D 1/04

[52] U.S. Cl. ..... 84/264

[58] Field of Search ..... 84/264, 265, 266

[56] References Cited

U.S. PATENT DOCUMENTS

| | | | |
|---|---|---|---|
| 617,514 | 1/1899 | Robbins | 84/266 |
| 3,853,030 | 12/1974 | Petutschnigg | 84/266 |

*Primary Examiner*—Robert E. Nappi
*Assistant Examiner*—Shih-yung Hsieh
*Attorney, Agent, or Firm*—Whitham, Curtis & Whitham

[57] ABSTRACT

A folk harp includes a foot pedal (19) sharping apparatus which allows the harpist to play semitones without removing his or her hands from the harp. The foot pedal (19) is connected to one or more cables (15) or strings (23) or other connecting devices, which, in turn cause a sharping member, such as a sharping hook (7) or lever (22) fitted with a dowel (26) to move a string (6) into contact with a tacito (1) positioned on the sound board (5) of the folk harp. The height and horizontal position of the tacito (1) relative to the contact point on string (6) can be adjusted to achieve precise semitones, while avoiding buzzing noises.

12 Claims, 1 Drawing Sheet

PEDAL SHARPING APPARATUS FOR FOLK HARPS

BACKGROUND OF THE INVENTION

1. Field of the Invention

The invention is generally related to musical instruments and, more particularly, to an apparatus for achieving semitones (i.e., "flats" and "sharps", sometimes referred to as "accidentals") on a folk harp using foot pedals.

2. Description of the Prior Art

Concert harps are very expensive, cumbersome, and complex instruments that include approximately 2400 moving parts which allow harpists to achieve accidentals by the use of foot pedals. This allows the harpist to achieve sharps and flats without taking his or her fingers off the strings.

Folk harps are generally defined as harps which are not concert harps. Folk harps can achieve accidentals only by interruption of the harpist's left hand playing by using the left hand to engage various types of levers which are typically mounted on the neck of the harp. Some types of Paraguayan folk harps allow the harpist to achieve an accidental by pressing the index finger of the left hand against a string which is situated slightly in front of a dowel-like projection, called a "tacito", which, in effect, shortens the object string, and thereby allows the right hand to pluck the accidental. In these types of folk harps, the tacitos are glued into the soundboard, such that their original placement must be precise in order to achieve the precise semitone.

SUMMARY OF THE INVENTION

It is an object of this invention to provide a simple, lightweight, and inexpensive foot pedal system for a folk harp which will allow the folk harpist to achieve a semitone without interrupting play.

According to the invention, a folk harp is modified by adding sharping hooks to the soundboard which, when activated by a pedal at the base at the back of the harp, draw the object string against a tacito placed directly in back of the string. The foot pedals are connected to the sharping hooks by means of cables, and, preferably are silent in operation. Guides on each side of a sharping hook keep it on track so that it will always strike the string slightly below the tacito, thereby producing a clear tone by shortening the string to the precise semitone. The foot pedals should be ergonomically easy for the harpist to engage, and actuation of a foot pedal preferably will not appreciably alter the plane or angle of the string.

Sharping hooks, guides, and tacitos can be placed on as many strings of the folk harp as desired; however, in the preferred embodiment of the invention the sharping hooks are placed on the c and c', d and d', f and f', g and g' and a and a' in the mid range of the melody strings, thus giving the harpist the same melody notes as appear on the white and black notes of a piano. This will be sufficient to play most melodies. In a preferred embodiment, the invention will be implemented in a way which allows the heel of the harpist's left foot to activate the c and d strings, controlling two octaves of c and c' and d and d'), and the heel of the right foot to activate the f, g, and a pedals, controlling two octaves of f and f', g and g', and a and a'. Since each person has different physical characteristics, the pedals can be lengthened or shortened to suit.

The sharping hooks, tacitos, and guides can be retrofitted to existing folk harps or added at the time of producing a new folk harp. The height of the sharping hooks can be adjusted or regulated from the underside of the soundboard to accommodate more or less return action, to suit the needs of the individual harpist. This can be accomplished using collars and springs, or equivalent components.

In addition, the height of the tacito, as well as its horizontal position in relation to the string can also be regulated. This can be accomplished using collars and set screws, or equivalent components. If the top portion of the tacito is too close to the string when it is plucked, the string will make an unpleasant buzzing sound. Thus, it is important to keep the tacito far enough away from the string to prevent buzzing, but close enough such that the sharping hook does not have to travel too far to bring the string into contact with the tacito. In a height adjustment, the tacito would simply be moved axially within the collar and set using the set screw.

Horizontal adjustments in the tacito can be achieved in a number of different ways, and are used to adjust the preciseness of the semitone. In this type of adjustment, the harpist is regulating where the tacito contacts the string, and thus the length of the string. In the preferred embodiment, the tacito head will be filed in a point, and the sharping hook brings the string into contact with the point of the tacito head. The position of the point can be varied simply by removing the tacito, and sharpening the head such that the point occurs at different positions. Alternatively, if the point is offset from center, the harpist can rotate the tacito about its axis such that the point of contact makes the string longer or shorter in one of two different positions. Since the tacito is preferably only approximately ¼ inch in diameter, it can be seen that the difference in point of contact is small. Still, as a further alternative, a set of tacitos can be provided, each at different angle locations such that each tacito contacts the string at a different location. In this embodiment, the harpist would simply remove the tacito and try a new tacito on the soundboard until he or she obtains the desired semitone.

To permit ease in transportation, the foot pedals should be able to be folded against the back of the harp.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
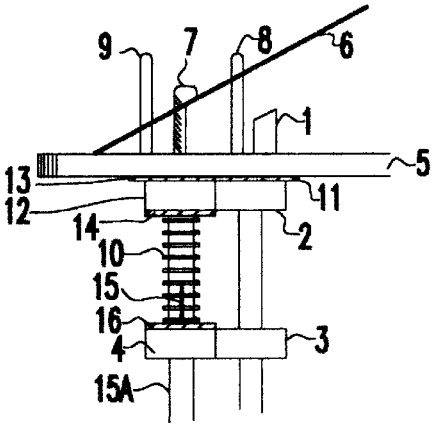
FIG. 1 is a side view of a sharping device according to a first embodiment of the invention.
Figure 2:
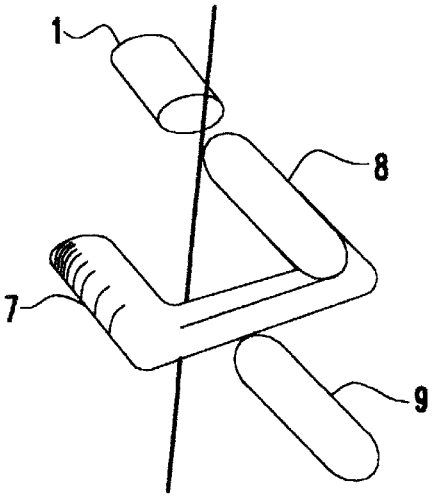
FIG. 2 is a top view of a sharping hook and guide on the top of the sound board of a folk harp.

With reference to FIGS. 1 and 2, a sharping hook 7, preferably made from brass, is slidably positioned on the sound board 5 of a folk harp, and is used to selectively pull string 6 against tacito 1. In a non-sharping position, the hook 7 does not contact the string 6; however, when a semitone is desired, the harpist actuates a foot pedal (shown in FIGS. 3 and 4) which causes cable 15, which is connected to the base of the sharping hook 7, to move axially downward through the sound board 5. Guides 8 and 9 keep the sharping hook 7 in position over string 6 as it traverses axially downward. The sharping hook 7 is offset from tacito 1 (preferably below the tacito), and its principle function is to pull the string 6 against the tacito 1 such that the vibrating length of the string 6 is effectively shortened, thus producing the desired semitone. The configuration of the sharping hook 7 is shown as an inverted "J"; however, other configurations may also be useful. The sharping hook 7 should be able to firmly hold the string 6 against the tacito when sharping is desired to produce a clear tone, but not appreciably alter the angle of the string 6. After a sharp is played, the sharping hook 7 is returned to its non-sharping position by the harpist removing his or her foot from the foot pedal, and the spring 10 biasing the sharping hook upward from the soundboard.

In the embodiment shown in FIG. 1, a collar 2 is used to secure tacito 1 at a desired height. The tacito 1 is inserted through the soundboard 5 into the collar 2, and secured by a set screw or equivalent connector (not shown). The sharping hook 7 is joined to cable 15 by crimping the cable within a hole at the base of the hook 7, or by other connection configurations, and the hook 7 and cable 15 combination passes through collar 12. Collar 12 is secured to the hook 7 by a set screw or the like, and serves the function of holding spring 10 between collar 12 and collar 4. Collar 12 is moveable axially with the hook 7, and axial motion of the cable 15 causes spring 10 to compress between collar 12 and collar 4, as the two collars are drawn closer together via movement of collar 12 towards collar 4. Collar 4 is connected to collar 3 or is integral therewith, and is held in position on the dowel-like end of tacito 1 by a set screw or equivalent connector.

When the harpist desires a sharp to be played, he or she depresses a footpedal (not shown) which draws on cable 15, which in turn pulls sharping hook 7 downward. Downward motion of the hook 7 brings the string 6 into contact with tacito 1, and compresses spring 10 between collar 12 and collar 4. Upon the harpist removing his or her heel from the pedal, the compressed spring 10 returns the sharping hook 7 to its position just slightly out of contact with string 6 by biasing collar 12 upwards, which, in turn, causes connected sharping hook 7 to move upwards.

To accommodate the preferences of the individual harpist, the height of the sharping hook 7 can be adjusted or regulated from the underside of the sound board 5 by adjusting the connection of collar 3 on the dowel-like end of tacito 1. As pointed out above, the collar 4 is either joined to collar 3 or integral therewith. Thus, by moving the collar 3 to a specified location, the height of the sharping hook 7, which will be dictated by the uncompressed spring 10, will be adjusted. As discussed above, the height of the tacito 1, and the height of the sharping hook should be set such that buzzing of the string 6 is avoided when the string is plucked, yet be close enough that the hook 7 can quickly bring the string 6 into engagement with the tacito.

Washers 11, 13, 14, and 16 can be provided on the collar arrangement to dampen any noise produced by axial movement of the sharping hook up and down through the collar system. A sheath 15*a* covers and protects the cable 15 between the foot pedal system and the collar system. Sheath 15*a* also serves to prevent kinking of the cable 15 and to permit easy sliding operation of the cable 15.

Other configurations for moving a sharping hook 7 up and down relative to a string 6 to bring it into contact with a tacito 1 mounted on the soundboard 5 could also be used. The chief advantage of this invention is that it allows a person to play a folk harp and make sharps without removing his or her fingers from the strings.

Figure 3:
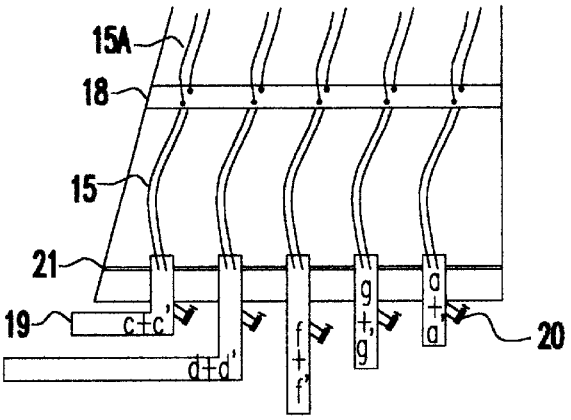
FIG. 3 is a schematic showing pedals positioned at the back of the folk harp.
Figure 4:
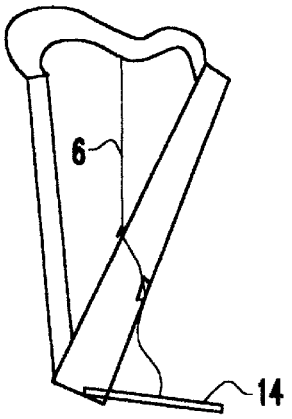
FIG. 4 is a schematic view of a folk harp showing foot pedal actuation of a sharping device positioned on the soundboard.

FIGS. 3 and 4 show that the sharping system of this invention can be implemented on any number of strings on the folk harp. In the preferred embodiment, the sharping hooks are placed on c and c', d and d', f and f', g and g' and a and a' in the mid range of the melody strings. The pedals 19 are positioned on a fulcrum 21, and cables 15 for each sharping system pass through the pedals and are secured thereto by cable stops 20 or other suitable devices. The height of the cables 15 can be adjusted to suit the individual harpist simply by adjusting the cable stop 20. Two cables 15 are secured to each pedal 19 so that two octaves of c, d, f, g, or a, can be sharped with one pedal 19. If additional octaves are desired, additional cables can be connected to each cable pedal 19. Alternatively, additional pedals can be provided for sharping additional strings. When a sharp is desired, the harpist depresses the pedal 19 with his or her heel which causes the pedal 19 to move angularly downward against fulcrum 21, which, in turn, causes the cable or cables 15 associated with that pedal 19 to be pulled downward. As discussed above, downward movement of cable 15 causes a sharping hook 7 to contact an associated string 6 and bring it in contact with tacito 1. After a sharp is played, the harpist simply releases the pedal 19 so that the sharping hook 7 returns to its non-sharping position.

FIG. 4 shows cable sheathing 15*a* is inserted into a stop arm 18. The stop arm 18 can take the form of a one inch thick piece of wood, and the sheathing could extend into a pilot hole which extends halfway into the wood. Cables 15 extend through holes in the stop arm 18 and are connected to pedals 19 as described above. The cable sheath 15*a* is immovable between stop arm 18 and collar 4 (FIG. 1), and the cable 15 is able to slide freely through the cable sheath 15*a*.

Regulation of the desired semitone can be achieved by a number of methods. Preferably the tacito will be used to top the string at exactly 0.0561256% of the length of the string to achieve the sharp desired. As discussed above, the height of the tacito can preferably be varied. As discussed below, the horizontal position at which the string contacts the tacito can also be varied.

Figure 6:
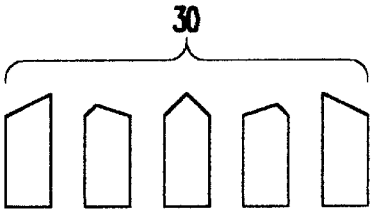
FIG. 6 is a side view showing alternative point configurations for a plurality of tacito dowels.

FIG. 6 shows several tacitos collectively referred to by numeral 30. The tacitos 30 each have a different angle filed on their top surface. In operation of the sharping system of this invention, the string contacts the tacito 30 on this angled surface. Thus, by filing the angled top surface at different locations, the horizontal position at which the string contacts the tacito can be changed. This, in turn, changes the horizontal position at which the string contacts the tacito, which, ultimately, changes the length of the vibrating string when the sharping system is actuated. Hence, one method by which more precise tones can be achieved simply involves having the harpist file the tacitos 30 at different angles. Another method of adjusting string length for tone generation is to simply rotate a tacito about its axis. With reference to the two outer tacitos and the two tacitos positioned between the two outer tacitos and the center tacitos, it can be seen that these are mirror images of one another. Thus, if a tacito is angled as shown in the far left end of FIG. 6, and the harp string extends to the right, the tacito can contact the string at its right side; however, by rotating the tacito so that it resembles the tacito at the far right end of FIG. 6, the string will contact the tacito at its left end. The right end contact shortens the harp string, while the left end contact lengthens the harp string. Hence, rotation about the tacito axis, followed by setting with a set screw or equivalent structure can achieve two slightly different tones. Alternatively, the tone could be adjusted simply by having a set of several different tacitos 30. In this scheme, the harpist would simply put in different tacitos 30 which contact the string at different horizontal positions until the desired tone is achieved.

Figure 5:
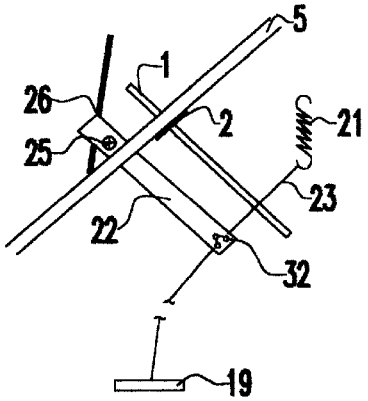
FIG. 5 is a side view of a sharping device according to a second embodiment of the invention.

FIG. 5 shows an alternative embodiment of the invention wherein a tacito 1 is connected to soundboard 5 behind string 6. As discussed above, the height of the tacito 1 can be varied using a collar 2 and set screw or other securing member, and, preferably, the tacito 1 is rotatable about its axis prior to being secured to collar 2 so as to provide pure semitones. The chief difference between the configuration of FIG. 5 and the configuration of FIG. 1, is the lever 22.

In FIG. 5, a string 23 is connected to a heavy spring 21 positioned inside or behind the harp sound chamber, and to the pedal 19. The string 23 is connected to one end of the lever 22 by through holes 32 drilled in the lever 22, by pin members, or by other equivalent means. The lever 22 passes through a slot (not shown) in the soundboard 5. A clamp (not shown) secures the lever 22 to the soundboard 5 at a pivot point 25, and the lever 22 is free to pivot towards and away from the tacito 1 by the harpist depressing the pedal 19. A dowel 26, or other string sharping member, passes through an end of the lever 22 and extends over the string 6. The dowel 26 moves the string 6 into contact with the head of tacito 1 when the lever 22 pivots downward under the force of the harpist depressing pedal 19. After the sharp is played, the harpist simply releases the pedal 19, and the heavy spring 21 causes the lever 22 to pivot upward by moving string 23 upward. This motion removes the dowel 26 from contacting the string 6 and the string 6 moves away from the tacito 1.

While the invention has been described in terms of its preferred embodiments, those skilled in the art will recognize that the invention can be practiced with modification within the spirit and scope of the appended claims.

We claim:

1. A sharping apparatus for a folk harp, comprising:

a tacito positioned adjacent a string of said folk harp on a sound board of said folk harp;

a sharping member positioned adjacent said string of said folk harp for contacting said string and moving said string into contact with said tacito, said sharping member being movable relative to said tacito, said sharping member comprises a moveable sharping hook which extends over said string, and a biasing member for biasing said sharping hook away from said string; and a foot pedal connected to said sharping member for moving said sharping member relative to said tacito.

2. The sharping apparatus of claim 1 wherein said sharping member comprises a lever which pivots towards and away from said tacito.

3. The sharping apparatus of claim 2 wherein said lever includes:

a string contacting member at a first end; and a tensioned pivot drive member connected to said foot pedal.

4. The sharping apparatus of claim 3 wherein said tensioned pivot drive includes a spring member for biasing said foot pedal.

5. The sharping apparatus recited in claim 1 wherein said biasing member comprises a spring which compresses as said sharping hook moves towards said tacito and which expands to move said sharping hook away from said tacito.

6. The sharping apparatus recited in claim 1 further comprising a guide for said sharping hook, said sharping hook being moveable within said guide.

7. The sharping apparatus recited in claim 1 wherein said foot pedal is connected to said sharping member by a cable.

8. The sharping apparatus recited in claim 1 wherein said foot pedal is connected to said sharping member by a string.

9. The sharping apparatus recited in claim 1 wherein said tacito is offset from said sharping member.

10. The sharping apparatus recited in claim 1 wherein said tacito is rotatable.

11. The sharping apparatus recited in claim 1 wherein said tacito is moveable.

12. The sharping apparatus recited in claim 1 wherein said foot pedal is pivotable relative to said harp.

* * * * *